US006581219B1

(12) United States Patent
Powaska

(10) Patent No.: US 6,581,219 B1
(45) Date of Patent: Jun. 24, 2003

(54) ROTARY SHOWER BRUSH FOR MOUNTING IN A SHOWER STALL

(76) Inventor: Tadeusz Powaska, 10 Manswood Crescent, Brampton, Ontario (CA), L6T 3Y7

( * ) Notice: Subject to any disclaimer, the term of this patent is extended or adjusted under 35 U.S.C. 154(b) by 0 days.

(21) Appl. No.: 10/084,733

(22) Filed: Feb. 26, 2002

(51) Int. Cl.[7] ..... A47K 7/02
(52) U.S. Cl. ..... 4/606
(58) Field of Search ..... 4/606

(56) References Cited

U.S. PATENT DOCUMENTS

| | | | | |
|---|---|---|---|---|
| 1,192,314 | A | 7/1916 | Howlett | |
| 1,965,774 | A | 7/1934 | Jaynes | 4/158 |
| 2,068,757 | A | 1/1937 | Mishelle | 4/158 |
| 2,657,685 | A | 11/1953 | Holland | 128/55 |
| 3,091,776 | A | 6/1963 | Roberts | 4/158 |
| 3,196,867 | A | 7/1965 | Perry | 128/56 |
| 3,678,523 | A | 7/1972 | Enchelmaier et al. | 15/21 D |
| 3,862,459 | A | 1/1975 | Brunette | 15/21 D |
| 4,008,503 | A | 2/1977 | Tharp | 15/21 D |
| 4,733,421 | A | 3/1988 | Kuersteiner | 15/21 D |
| D298,291 | S | 11/1988 | Lanier | D6/524 |
| 4,817,227 | A | 4/1989 | Scott | 15/21 R |
| 4,858,257 | A | 8/1989 | Bivens | 4/606 |
| 5,675,846 | A | 10/1997 | Kannenberg | 4/606 |
| 5,870,782 | A | 2/1999 | Kannenberg | 4/606 |

*Primary Examiner*—Charles E. Phillips
(74) *Attorney, Agent, or Firm*—Richard L. Miller

(57) ABSTRACT

A rotary shower brush for mounting in a shower stall that includes a brush assembly, a motor assembly, an upper mount assembly, and a lower mount assembly. The brush assembly vertically mounts in the shower stall. The motor assembly is operatively connected to, and rotates, the brush assembly. The upper mount assembly is attached to the motor assembly and attaches the motor assembly to the shower stall. The lower mount assembly is attached to the brush assembly and attaches the brush assembly to the shower stall. Variations of the upper mount assembly and the lower mount assembly allow the rotary shower brush to be attached to either the ceiling and the base of the shower stall or to a corner of the shower stall. In another embodiment, the brush assembly oscillates up and down as it rotates.

8 Claims, 3 Drawing Sheets

ROTARY SHOWER BRUSH FOR MOUNTING IN A SHOWER STALL

BACKGROUND OF THE INVENTION

1. Field of the Invention

The present invention relates to a rotary shower brush. More particularly, the present invention relates to a rotary shower brush for mounting in a shower stall.

2. Description of the Prior Art

Numerous innovations for bathing machines have been provided in the prior art that will be described. Even though these innovations may be suitable for the specific individual purposes to which they address, however, they differ from the present invention.

A first example, U.S. Pat. No. Des. 298,291 to Lanier teaches the ornamental design for a combined wall-mounted water-powered shower brush and accessory shelf unit.

A second example, U.S. Pat. No. 1,192,314 to Howlett teaches in combination with a bathing apparatus, of an annular series of vertically disposed rotary brushes, each having at one end a driven gear, and a common driving gear concentric with the annular series of brushes and in driving relation to all of said driven gears.

A third example, U.S. Pat. No. 1,965,774 to Jaynes teaches a bathing machine including a combined scrubbing and massaging element, motor operated means connected with said element for imparting a longitudinal surging movement thereto, and a water supply including a valve adapted to be opened for wetting said element.

A fourth example, U.S. Pat. No. 2,068,757 to Mishelle teaches a back cleaner and massager having a housing provided in its front wall with an opening, a plurality of cylindrical applicators mounted for a vertical reciprocatory movement within the housing, portions of which applicators project through the opening the front wall thereof, means within the housing to the rear of the opening for spraying liquid forwardly through the opening in said housing, a fluid pressure motor within the housing and driving connections between said motor and said applicators.

A fifth example, U.S. Pat. No. 2,657,685 to Holland teaches a mechanical body massager adapted for mounting within a shower stall, said massager comprising an elongated vertical shaft mounted for rotation on its longitudinal, vertical axis and having a plurality of slots therethrough; and an elongated, flexible slapping panel in each slot respectively and extending radially from the shaft in opposite directions.

A sixth example, U.S. Pat. No. 3,091,776 to Roberts teaches a shower apparatus comprising an enclosure, pairs of vertically aligned upper and lower bearings mounted in the enclosure, said lower bearings being rockable in a vertical plane, vertical driven shafts journaled in the upper bearings, vertical driven shafts removably journaled in said lower bearings in alignment with the drive shafts, cylindrical brushes mounted on the driven shafts for rotation therewith, means for actuating the drive shafts in unison, and means for operatively and detachably connecting said drive shafts to the driven shafts whereby said driven shafts may be swung out of alignment with said drive shafts and removed from said lower bearings.

A seventh example, U.S. Pat. No. 3,196,867 to Perry teaches a appliance for massaging the body of a person including a back panel; a first bearing plate fixed to said back panel and extending therefrom; a second bearing plate fixed to said back panel and extending therefrom, said second bearing plate having a plurality of recesses opening into each other; at least three cylindrical brushes disposed between said bearing plates with one end of each of said brushes journaled in said first bearing plate and the other end of each of said brushes journaled in said second bearing plate, the axes of said brushes being parallel to each other and disposed so that the cylindrical surface of said several brushes can simultaneously engage the back of the torso of a person; a plurality of gears rotatably disposed in the recesses of said second bearing plate in intermeshing relationship to constitute a gear train for rotating said brushes in unison so that pairs of said brushes have their cylindrical surfaces moving away from each other as they contact the back of the person to tend to spread the skin of the person along elongated areas while other pairs of said brushes are rotating in directions to move their cylindrical surfaces into contact with the back of the person toward each other to tend to draw the skin together along elongated areas for producing a pleasant and relaxing sensation to the person using the appliance, the ends of said brushes that are journalled in said second bearing plate being coupled to said gears for rotation therewith; a cover plate fixed to said second bearing plate to overlie the recesses and enclose said gears therein; and a source of power connected to drive said gear train for rotating said brushes.

An eighth example, U.S. Pat. No. 3,678,523 to Enchelmaier et al. teaches a brushing device having a manually driven brush rotatable about its longitudinal axis. The brush is oscillated by means of a pull cord wrapped around a pulley which is drivingly connected to the brush, at least one span of the pull cord extending directly from the pulley to be grasped by a hand of the operator. Preferably the cord has two such spans, which extend from opposite sides of the pulley, and which are engaged and pulled by the respective hands of the operator. Some of the disclosed embodiments of the device are particularly adapted for use as bathing aids. In certain disclosed embodiments, the brush rains in a fixed axial position. In other embodiments, the brush, which is mounted vertically, is free for vertical travel throughout a limited range under the influence of the pulls on the said spans of the pull cord. In yet another embodiment, wherein the device is disposed vertically, the brush oscillating cords may selectively be pulled either horizontally or vertically.

A ninth example, U.S. Pat. No. 3,862,459 to Brunette teaches a back scrubber and massager apparatus to be used in a bathing enclosure, such as a shower stall, to allow the user to wash his back or to give himself a back massage by merely standing with his back to the apparatus. The back scrubber and massager apparatus is adjustable for different size and type bathing enclosures, and also for users of different heights.

A tenth example, U.S. Pat. No. 4,008,503 to Tharp teaches a driven rotary brush that is mounted on an adjustable plate, and the adjustable plate is mounted through rails and runners to a wall plate. The wall plate has quick mounting devices such as suction cups for quick attachment. The rails and runners provide easy vertical height adjustment. The brush has a central member functioning as a sprayer that is easily connected through flexible tubing to the supply pipe for the shower spray head.

A eleventh example, U.S. Pat. No. 4,733,421 to Kuersteiner teaches an apparatus that consists of a vertically upright rotatable brush roller arranged in an outwardly opening groove of a water-tight housing. An arcuate water supply pipe with plural water nozzles is provided above the upper peripheral edge of the roller. The periphery of the roller protects from the groove. The side edges of the groove are provided with air-jet nozzles which are directed tangentially to the roller. A standing against the brush roller permits a washing and/or massaging of the human body, whereby the washing process is aided by a curtain of water created by the water supply to the water pipe having plural downwardly directed water nozzles. An acceleration of the drying process is enhanced by the air-jet nozzles. The brush roller is equipped with nylon bristles.

A twelfth example, U.S. Pat. No. 4,817,227 to Scott teaches a user-powered body scrubber for use in a tub or shower. It includes at least one elongated vertical guide member, and brackets for mounting the guide member outwardly from the wall in spaced, parallel relation to the wall. A brush carriage is fitted to the vertical member in slidably captive relation for movement vertically along the guide member. At least one circular brush is carried by the brush carriage for rotation about an axis perpendicular to such movement along the guide member. A friction roller or rack-and-pinion arrangement causes the brush to rotate in response to said movement along the guide member. A cable has one end connected to the carriage, there being a first cable reach extending upwardly from the carriage along the guide member to a horizontal swingable arm including pulleys, the cable extending over the pulleys to provide a downwardly extending cable reach with a handle for being pulled by the user to lift the carriage upwardly along the guide member and for being released to permit the carriage to move downwardly along the guide member. The user places the body against the rotating brush while alternately pulling and releasing the cable to cause the brush to oscillate vertically as well as to oscillate rotatingly accordingly.

A thirteenth example, U.S. Pat. No. 4,858,257 to Bivens teaches a body brush shower stall in which a body brush is vertically oriented and supported from a single bearing, and driven through a clutch mechanism from a gear box and electrical motor at a speed range greater than about 90 rpm and below about 120 rpm. The body brush is mounted on the vertical drive shaft and has soft flexible bristles which hang and droop downwardly at speeds below 90 rpm and which extends substantially horizontally when rotated at speeds about 90 rom and a spray bay sprays liquid on the elongated body brush at spaced points along the length thereof to maintain the lubricity of the bristles at a certain level. The bristles are soft and flexible and conform to body contours to provide the unique massage, clean and scrubbing action to cleanse the skin surfaces of dirt, scale and provide a certain invigorating action. A stall is provided having a pair of end walls, back walls and short front side walls, the short front side walls defining an entranceway upon which a door is hung and a three-sided chamber for the body brush and a seat section for a bather spaced from the body brush a distance short enough that a bather can sit on the seat and place his or her feet into the rotating brush. A venturi system is utilized for injecting various soaps, body lotions, body oils or rinse additives to the water sprayed on the body brush to maintain the lubricity thereof.

A fourteenth example, U.S. Pat. No. 5,675,846 to Kannenberg teaches the devices of the brush-massage shower installation described in detail above do not pose any problems in practical application, while a person lets his body be massaged with the skin-friendly bristles, which he has selected himself, of a dry or water-spraying and wet-cleaning rotating massage roller. The brush-massage shower installation contains the advantages of freedom in the selection of the driving elements.

a.) The water turbine gear, which is responsible for the infinitely variable drive of the water-spring rotating massage roller, obtains its rotational force from the water supply provided, which is under pressure.

b.) The dry-running rotating massage roller is put into motion by a gear motor, the design of which is kept flat and which is electrically protected and infinitely variable and which is located in the outer wall side of the bath, from where it puts the electrically protected gear connected to the inner wall side into motion for rotating the rotating massage roller. A full brush massage with the rotating massage roller invigorates the human body and spirit. It sees to a good blood flow through the skin and body, by which it stimulates the metabolism, strengthens the vegetative nervous system and the immune system, increases the resistance to infectious diseases and thus awakens the human zest for life.

A fifteenth example, U.S. Pat. No. 5,870,782 to Kannenberg teaches a fitness-brush shower installation that has a head rod including a drive head. The head rod is pivotable in a horizontal plane and can be secured at a selected position. A vertical, rotatable brush roller is interchangeably suspended on a drive head under the head rod. A gear is coupled to at least one drive comprising conical gear-wheel shafts which set the brush roller in rotation. The gear is coupled to a brush-roller driver. The brush roller telescopically extendable in the vertical direction. Its extension is a function of water flowing into a hollow brush core of the brush roller, resisted by a restoring spring.

It is apparent that numerous innovations for bathing machines have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a rotary shower brush for mounting in a shower stall that avoids the disadvantages of the prior art.

Another object of the present invention is to provide a rotary shower brush for mounting in a shower stall that is simple and inexpensive to manufacture.

Still another object of the present invention is to provide a rotary shower brush for mounting in a shower stall that is simple to use.

Briefly stated, still yet another object of the present invention is to provide a rotary shower brush for mounting in a shower stall that includes a brush assembly, a motor assembly, an upper mount assembly, and a lower mount assembly. The brush assembly vertically mounts in the shower stall. The motor assembly is operatively connected to, and rotates, the brush assembly. The upper mount assembly is attached to the motor assembly and attaches the motor assembly to the shower stall. The lower mount assembly is attached to the brush assembly and attaches the brush assembly to the shower stall. Variations of the upper mount assembly and the lower mount assembly allow the rotary shower brush to be attached to either the ceiling and the base of the shower stall or to a corner of the shower stall. In another embodiment, the brush assembly oscillates up and down as it rotates.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

First Embodiment

Figures 1, 2:
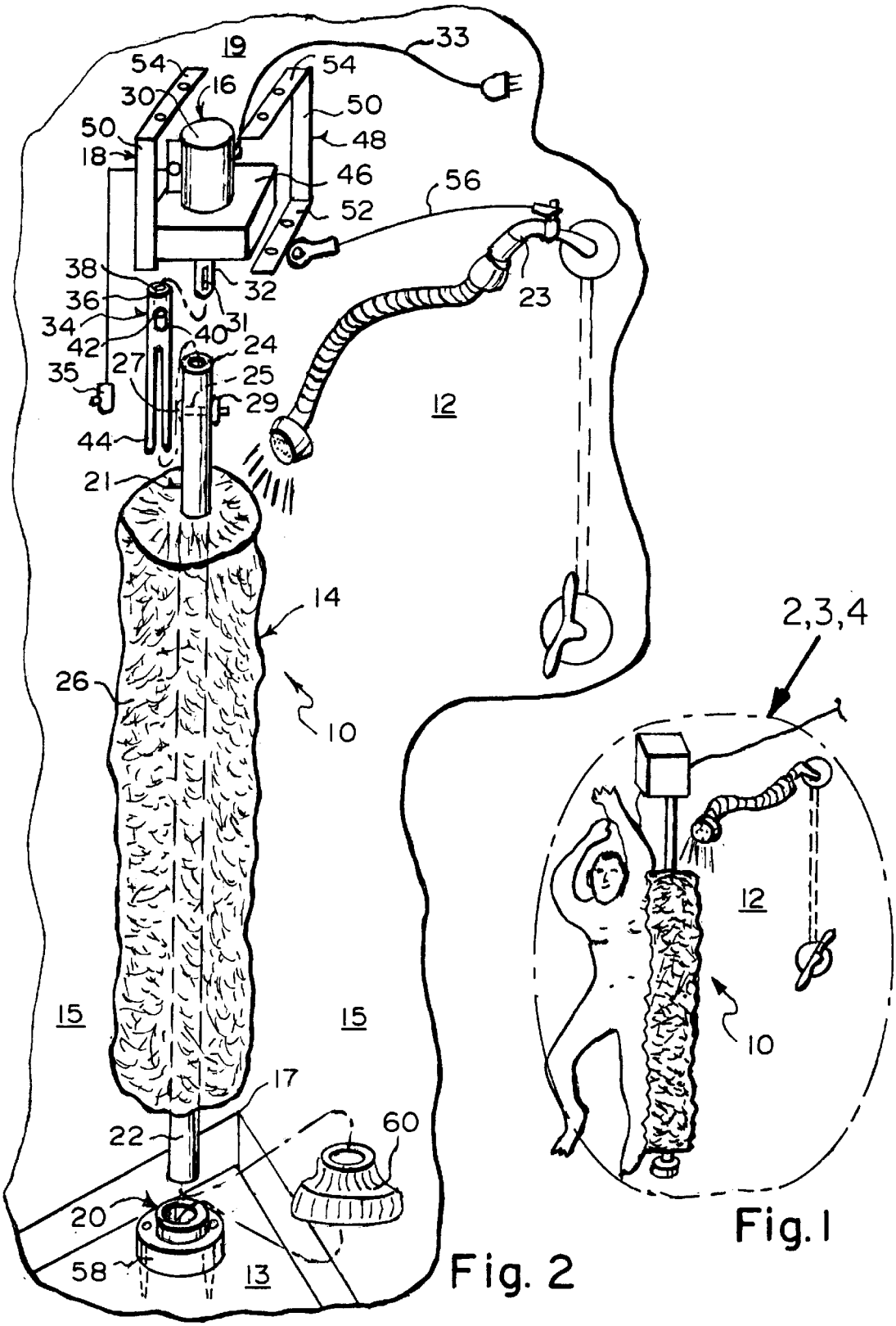
FIG. 1 is a diagrammatic perspective view of the present invention in use.
FIG. 2 is an enlarged diagrammatic perspective view of the area generally enclosed by the dotted curve identified by arrow 2 in FIG. 1 of a first embodiment of the present invention.

10 rotary shower brush of present invention for mounting in shower stall 12
12 shower stall
13 base of shower stall 12
14 brush assembly for vertically mounting in shower stall 12
15 pair of walls of shower stall 12
16 motor assembly
17 corner of shower stall 12
18 upper mount assembly for attaching motor assembly 16 to shower stall 12
19 ceiling of shower stall 12
20 lower mount assembly for attaching brush assembly 14 to shower stall 12
21 shaft of brush assembly 14
22 lowermost end of shaft 21 of brush assembly 14
23 shower head of shower stall 12
24 uppermost end of shaft 21 of brush assembly 14
25 throughbore in uppermost end 24 of shaft 21 of brush assembly 14
26 brush of brush assembly 14
27 bolt of brush assembly 14
29 nut of brush assembly 14
30 motor of motor assembly 16
31 throughslot in motor-shaft 32 of motor 30 of motor assembly 16
32 motor-shaft of motor 30 of motor assembly 16
33 power cord of motor 30 of motor assembly 16
34 fork of motor assembly 16
35 on/off pull chain of motor 30 of motor assembly 16
36 unitary end of fork 34 of motor assembly 16
37 trip switch of motor assembly 16
38 blindbore in unitary end 36 of fork 34 of motor assembly 16
40 throughbore in unitary end 38 of fork 34 of motor assembly 16
42 bolt of fork 34 of motor assembly 16
44 bifurcated end of fork 34 of motor assembly 16
46 block of upper mount assembly 18
48 bracket of upper mount assembly 18 for attaching to ceiling 19 of shower stall 12
50 pair of members of bracket 48 of upper mount assembly 18
52 lowermost portions of pair of members 50 of bracket 48 of upper mount assembly 18
54 uppermost portions of pair of members 50 of bracket 48 of upper mount assembly 18 for attaching to ceiling 19 of shower stall 12
56 grounding wire of bracket 48 of upper mount assembly 18 for attaching to shower head 23 to ground motor 30 of motor assembly 16
58 bearing of lower mount assembly 20 for attaching to base 13 of shower stall 12
60 rubber boot of lower mount assembly 20

Second Embodiment

110 rotary shower brush
116 motor assembly
118 upper mount assembly for attaching motor assembly 116 to corner 17 of shower stall 12
120 lower mount assembly
148 bracket of upper mount assembly 118 for attaching to corner 17 of shower stall 12
150 main portion of bracket 148 of upper mount assembly 118
152 pair of flanges of bracket 148 of upper mount assembly 118 for attaching to walls 15 of shower stall 12
154 cover of upper mount assembly 118
156 bracket of lower mount assembly 120
158 bearing of lower mount assembly 120
160 block of lower mount assembly 120 for resting on base 13 of shower stall 12
162 side bracket

Third Embodiment

210 rotary shower brush
214 brush assembly
220 lower mount assembly
221 shaft of brush assembly 214
226 brush of brush assembly 214
258 bearing of lower mount assembly 220
262 tube of brush assembly 214
264 uppermost end of tube 262 of brush assembly 214
266 thoughslot in uppermost end 264 of tube 262 of brush assembly 214
268 lowermost end of tube 262 of brush assembly 214
270 thoughslot in lowermost end 268 of tube 262 of brush assembly 214
272 cam surface on lowermost end 268 of tube 264 of brush assembly 214
274 pair of upper bearings of shaft 221 of brush assembly 214
276 pair of lower bearings of shaft 221 of brush assembly 214
278 cam surface of bearing 258 of lower mount assembly 220
280 side bearing of cam surface 278 of bearing 258 of lower mount assembly 220

DETAILED DESCRIPTION OF THE PREFERRED EMBODIMENT

Referring now to the figures, in which like numerals indicate like parts, and particularly to FIG. 1, the rotary shower brush of the present invention is shown generally at 10 for mounting in a shower stall 12.

The overall configuration of the rotary shower brush 10 can best be seen in FIG. 2, and as such, will be discussed with reference thereto.

The shower stall 12 has a base 13, a pair of walls 15 forming a corner 17, a ceiling 19, and a shower head 23

The rotary shower brush 10 comprises a brush assembly 14 for vertically mounting in the shower stall 12, a motor assembly 16 that is operatively connected to, and rotates, the brush assembly 14, an upper mount assembly 18 that is attached to the motor assembly 16 and is for attaching the motor assembly 16 to the shower stall 12, and a lower mount assembly 20 that is attached to the brush assembly 14 and is for attaching the brush assembly 14 to the shower stall 12.

A first embodiment of the rotary shower brush 10 can best be seen in FIGS. 2 and 2A, and as such, will be discussed with reference thereto.

The brush assembly 14 comprises a shaft 21 that is hollow, slender, elongated, and vertically-oriented. The shaft 21 has a lowermost end 22 that rotatably engages the lower mount assembly 20, and an uppermost end 24 that is operatively connected to the motor assembly 16. The uppermost end 24 of the shaft 21 has a throughbore 25 extending transversely therethrough, through which a bolt 27 and nut 29 extend.

The brush assembly 14 further comprises a brush 26 that is generally cylindrically-shaped. The brush 26 coaxially receives, and rotates with, the shaft 21, and extends from below the uppermost end 24 of the shaft 21 to above the lowermost end 22 of the shaft 21.

Figures 2A, 3, 3A:
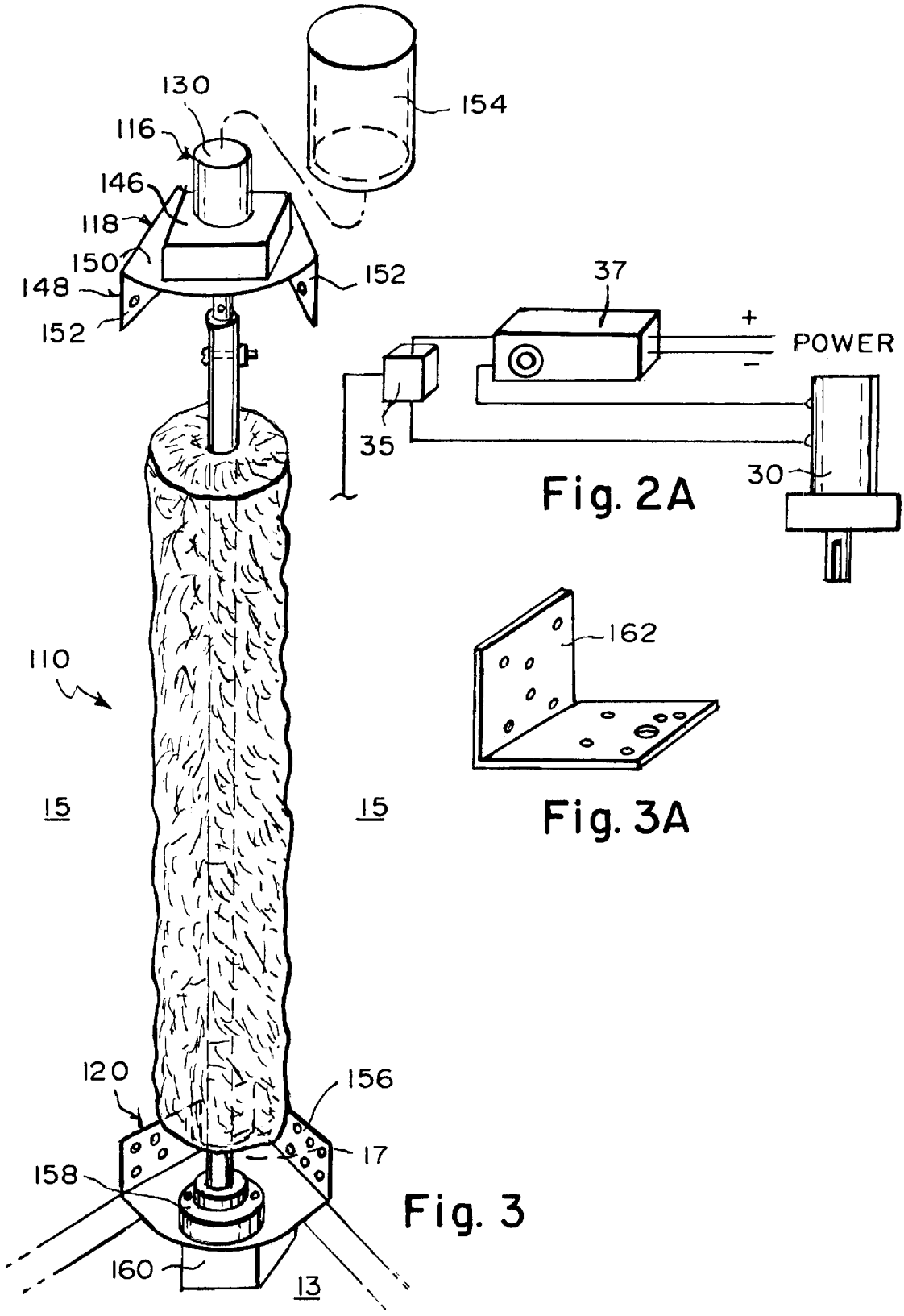
FIG. 2A is a schematic diagram of the circuit of the present invention.
FIG. 3 is an enlarged diagrammatic perspective view of the area generally enclosed by the dotted curve identified by arrow 3 in FIG. 1 of a second embodiment of the present invention.
FIG. 3A is a diagrammatic perspective view of a bracket for a wall installation.

The motor assembly 16 comprises a motor 30 that has an motor-shaft 32 that depends therefrom, a power cord 33 that extends therefrom, an on/off pull chain 35 that depends therefrom, and a trip switch 37, stops the motor when overloaded and is in electrical communication between the motor 30 and the on/off pull chain 35 (see FIG. 2A). The motor-shaft 32 of the motor 30 is vertically-oriented, positioned above, and coaxially with, the uppermost end 24 of the shaft 21, and has a throughslot 31 extending transversely therethrough.

The motor assembly 16 further comprises a fork 34 that has a unitary end 36 with a blindbore 38 extending axially therein and a throughbore 40 extending transversely therethrough and communicating with the blindbore 38 therein.

The blindbore 38 in the unitary end 36 of the fork 34 coaxially receives the motor-shaft 32 of the motor 30, and a bolt 42 extends through the throughbore 40 in the unitary end 38 of the fork 34 and the throughslot 31 in the motor-shaft 32 of the motor 30 so as to maintain the fork 34 on the motor-shaft 32 of the motor 30.

The fork 34 further has a bifurcated end 44 that depends coaxially from the unitary end 36 thereof. The bifurcated end 44 of the fork 34 is coaxially received in the uppermost end 24 of the shaft 21 and straddles the bolt 27 of the brush assembly 14 so as to allow for height adjustability.

The upper mount assembly 18 is for attaching the motor assembly 16 to the ceiling 19 of the shower stall 12. The upper mount assembly 18 comprises a block 46, through which the motor-shaft 32 of the motor 30 depends, and a bracket 48 that attaches to the block 46 and is for attaching to the ceiling 19 of the shower stall 12.

The bracket 48 comprises a pair of members 50 that are C-shaped and have lowermost portions 52 that attach to the block 46 and uppermost portions 54 that are for attaching to the ceiling 19 of the shower stall 12.

The bracket 48 further comprises a grounding wire 56 that is attached thereto and which is for attaching to the shower head 23 to ground the motor 30.

The lower mount assembly 20 is for attaching the brush assembly 14 to the base 13 of the shower stall 12. The lower mount assembly 20 comprises a bearing 58 that rotatably receives the lowermost end 22 of the shaft 21 and is for attaching to the base 13 of the shower stall 12, and a rubber boot 60 that covers, and waterproof, the bearing 58.

A second embodiment of the rotary shower brush 110 can best be seen in FIGS. 3 and 3A, and as such, will be discussed with reference thereto.

The rotary shower brush 110 is similar to the rotary shower brush 10, except:

1. The upper mount assembly 118 is for attaching the motor assembly 116 to the corner 17 of the shower stall 12.
2. The bracket 148 is for attaching to the corner 17 of the shower stall 12.
3. The bracket 148 has a main portion 150 that is substantially triangular-shaped with a truncated apex for accomodating rounded corners of the shower stall 12 and attaches to the block 146, and a pair of flanges 152 that depend from the mean portion 150 and are for attaching to the walls 15 of the shower stall 12.
4. The upper mount assembly 118 comprises a cover 154 that protects the motor 130.
5. The lower mount assembly 120 comprises a bracket 156 which is similar to the bracket 148 except that it is inverted and has the bearing 158 supported on the main portion thereof.
6. The lower mount assembly 120 comprises a block 160 that supports the main portion of the bracket 156 and is for resting on the base 13 of the shower stall 12.
7. The bracket 148 of the upper mount assembly 118 and/or the bracket of the lower mount assembly 120 may use a side bracket 162 in conjunction therewith, if convenient (see FIG. 3A).

Figures 4, 5, 6:
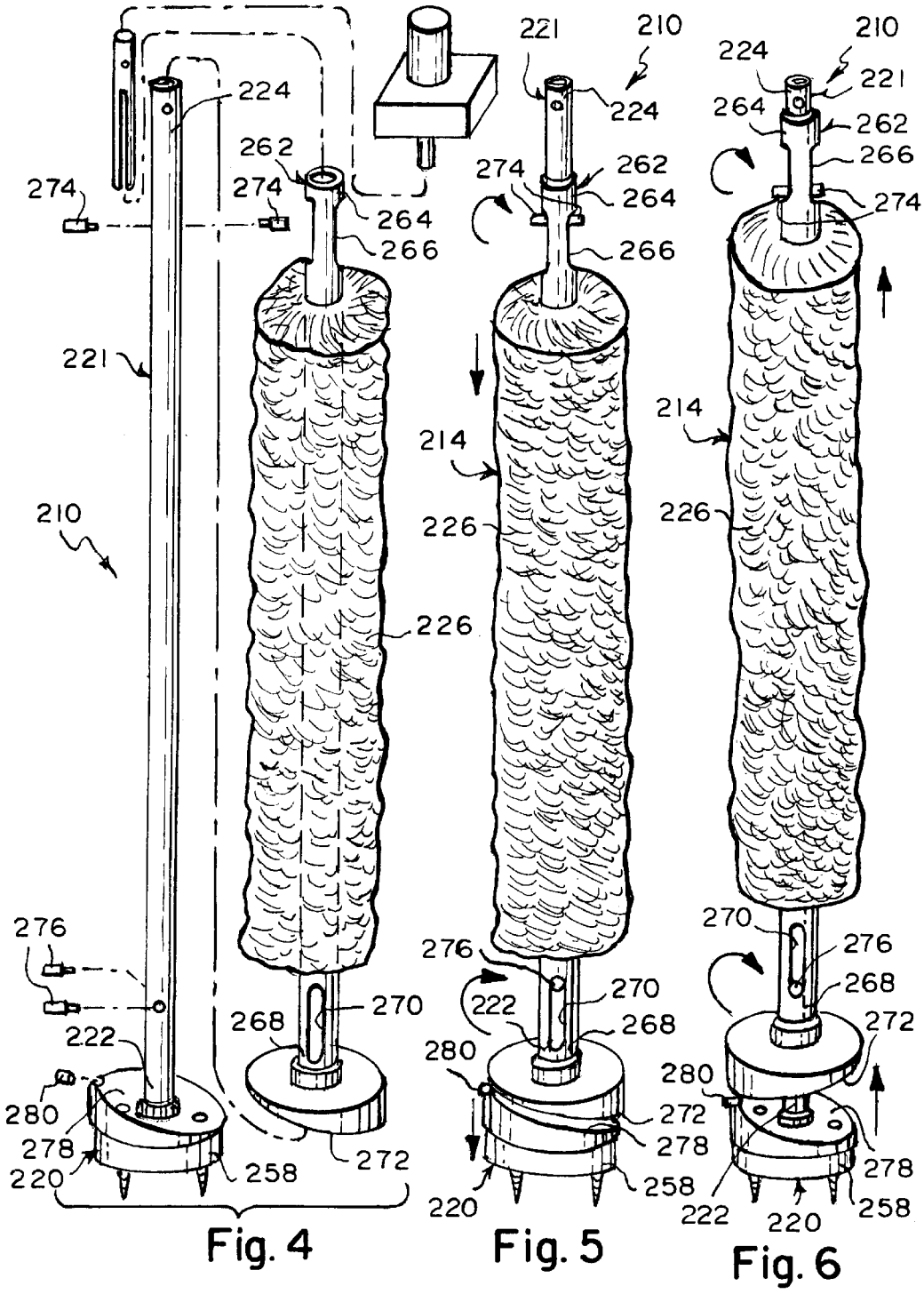
FIG. 4 is an enlarged exploded diagrammatic perspective view of the area generally enclosed by the dotted curve identified by arrow 4 in FIG. 1 of a third embodiment of the present invention.
FIG. 5 is a perspective view of the third embodiment of the present invention in the down position.
FIG. 6 is a perspective view of the third embodiment of the present invention in the up position.

A third embodiment of the rotary shower brush 210 can best be seen in FIGS. 4–6, and as such, will be discussed with reference thereto.

The rotary shower brush 210 is similar to the rotary shower brushes 10 and 110, except:

1. The brush assembly 214 has a tube 262 that concentrically receives the shaft 221 and has the brush 226 thereon.
2. The tube 262 has an uppermost end 264 with a thoughslot 266 that extends transversely therethrough and is disposed above the brush 226.
3. The tube 282 has a lowermost end 268 with a thoughslot 270 that extends transversely therethrough and is disposed below the brush 226.
4. The brush assembly 214 has a cam surface 272 disposed on the lowermost end 268 of the tube 264 for rotation therewith.
5. The shaft 221 has a pair of upper bearings 274 extending diametrically outwardly therefrom, in proximity to the uppermost end 224 thereof. The pair of upper bearings 274 ride vertically in the throughslot 266 in the uppermost end 264 of the tube 262 and transmit rotation from the shaft 221 to the tube 262.
6. The shaft 221 has a pair of lower bearings 276 extending diametrically outwardly therefrom, in proximity to the lowermost end 222 thereof. The pair of lower bearings 276 ride vertically in the throughslot 270 in the lowermost end 268 of the tube 262 and transmit rotation from the shaft 221 to the tube 262.

7. The bearing 258 has a cam surface 278 disposed thereon that engages the cam surface 272 on the tube 262 so that when the shaft 221 rotates, the cam surface 272 on the tube 262 rides up and down on the cam surface 278 on the bearing 258 causing the tube 262 to ride up and down on the shaft 221, and in so doing, the brush 226 is caused to oscillate up (see FIG. 6) and down (see FIG. 5) as it rotates.

8. The cam surface 278 of the bearing 258 has a side bearing 280 at a highest point thereon to ensure smooths motion between the cam surface 272 on the tube 262 and the cam surface 278 on the bearing 258.

It will be understood that each of the elements described above, or two or more together, may also find a useful application in other types of constructions differing from the types described above.

While the invention has been illustrated and described as embodied in a rotary shower brush for mounting in a shower stall, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific spects of this invention.

The invention claimed is:

1. A rotary shower brush for mounting in a shower stall, wherein the shower stall has a base, a pair of walls forming a corner, a ceiling, and a shower head, said brush comprising:

a) a brush assembly;

b) a motor assembly;

c) an upper mount assembly; and d) a lower mount assembly;

wherein said brush assembly is for vertically mounting in the shower stall;

wherein said motor assembly is operatively connected to said brush assembly;

wherein said motor assembly rotates said brush assembly;

wherein said upper mount assembly is attached to said motor assembly;

wherein said upper mount assembly is for attaching said motor assembly to the shower stall;

wherein said lower mount assembly is attached to said brush assembly;

wherein said lower mount assembly is for attaching said brush assembly to the shower stall;

wherein said brush assembly comprises a shaft;

wherein said shaft is hollow;

wherein said shaft is slender;

wherein said shaft is elongated;

wherein said shaft is vertically-oriented;

wherein said shaft has a lowermost end;

wherein said lowermost end of said shaft rotatable engages said lower mount assembly;

wherein said shaft has an uppermost end;

wherein said uppermost end of said shaft is operatively connected to said motor assembly;

wherein said uppermost end of said shaft has a throughbore;

wherein said throughbore extends transversely through said uppermost end of said shaft;

wherein a bolt extends through said throughbore in said uppermost end of said shaft;

wherein said brush assembly comprises a brush;

wherein said brush is generally cylindrically-shaped;

wherein said brush coaxially receives said shaft;

wherein said brush rotates with said shaft;

wherein said brush extends from below said uppermost end of said shaft to above said lowermost end of said shaft;

wherein said lower mount assembly comprises a bearing;

wherein said bearing rotatable receives said lowermost end of said shaft;

wherein said brush assembly has a tube;

wherein said tube concentrically receives said shaft; and wherein said tube has said brush thereon.

2. The brush as defined in claim 1, wherein said tube has an uppermost end;

wherein said uppermost end of said tube has a thoughslot;

wherein said throughslot extends transversely through said uppermost end of said tube; and wherein said throughslot in said uppermost end of said tube is disposed above said brush.

3. The brush as defined in claim 2, wherein said shaft has a pair of upper bearings;

wherein said pair of upper bearings extend diametrically outwardly from said shaft;

wherein said pair of upper bearings are disposed in proximity to said uppermost end of said shaft;

wherein said pair of upper bearings ride vertically in said throughslot in said uppermost end of said tube; and wherein said pair of upper bearings transmit rotation from said shaft to said tube.

4. The brush as defined in claim 1, wherein said brush assembly has a cam surface;

wherein said cam surface is disposed on said lowermost end of said tube; and wherein said cam surface rotates with said lowermost end of said tube.

5. The brush as defined in claim 4, wherein said bearing has a cam surface disposed thereon; and wherein said cam surface on said bearing engages said cam surface on said tube so as to allow said cam surface on said tube to ride up and down on said cam surface on said bearing as said shaft rotates which causes said tube to ride up and down on said shaft, and in so doing, said brush is caused to oscillates up and down as it rotates.

6. The brush as defined in claim 5, wherein said cam surface of said bearing has a side bearing;

wherein said side bearing is at a highest point on said cam surface of said bearing; and wherein said side bearing ensures smooth motion between said cam surface on said tube and said cam surface on said bearing.

7. The brush as defined in claim 1, wherein said tube has a lowermost end;

wherein said lowermost end of said tube has a thoughslot;

wherein said throughslot extends transversely through said lowermost end of said tube; and wherein said throughslot in said lowermost end of said tube is disposed below said brush.

8. The brush as defined in claim 7, wherein said shaft has a pair of lower bearings;

wherein said pair of lower bearings extend diametrically outwardly from said shaft;

wherein said pair of lower bearings are disposed in proximity to said lowermost end of said shaft;

wherein said pair of lower bearings ride vertically in said throughslot in said lowermost end of said tube; and wherein said pair of lower bearings transmit rotation from said shaft to said tube.

* * * * *